United States Patent [19]

Josefowicz

[11] Patent Number: 4,582,584

[45] Date of Patent: Apr. 15, 1986

[54] METAL ELECTROLYSIS USING A SEMICONDUCTIVE METAL OXIDE COMPOSITE ANODE

[75] Inventor: Jack Y. Josefowicz, Westlake Village, Calif.

[73] Assignee: Atlantic Richfield Company, Los Angeles, Calif.

[21] Appl. No.: 709,148

[22] Filed: Mar. 7, 1985

[51] Int. Cl.[4] ..... C25C 3/12

[52] U.S. Cl. ..... 204/243 R; 204/67; 204/70; 204/292

[58] Field of Search ..... 204/64 R, 67, 70, 243 R, 204/244–247, 291, 292

[56] References Cited

U.S. PATENT DOCUMENTS

| | | | |
|---|---|---|---|
| 3,692,645 | 9/1972 | Marincek | 204/70 |
| 3,960,678 | 6/1976 | Alder | 204/243 R |
| 4,187,155 | 2/1980 | de Nora et al. | 204/243 R |
| 4,338,177 | 7/1982 | Withers et al. | 204/243 R |
| 4,417,097 | 11/1983 | Das | 204/243 R |
| 4,448,654 | 5/1984 | Spangenberg et al. | 204/70 |
| 4,454,015 | 6/1984 | Ray et al. | 204/292 |
| 4,478,693 | 10/1984 | Ray | 204/70 |

*Primary Examiner*—John F. Niebling
*Assistant Examiner*—Terryence Chapman

[57] ABSTRACT

A cell for the electrolytic deposition of metal at low temperatures and low electrical consumption in which the electrolytic molten bath comprises halide salt having low solubility for the metal oxide at normal operating conditions. The novel anode of this invention comprises an effective amount of a selected N-type or P-type metal.

8 Claims, No Drawings

METAL ELECTROLYSIS USING A SEMICONDUCTIVE METAL OXIDE COMPOSITE ANODE

FIELD OF THE INVENTION

This invention relates to the electrolytic production of a metal from a metallic oxide-containing anode using a bath having very low solubility for the metal. More particularly, this invention relates to using a metallic oxide-containing anode which includes effective amounts of selected metals which increase the dissolution of the metallic oxide into the bath.

BACKGROUND OF THE INVENTION

The commercial production of certain metals, particularly aluminum and magnesium, has been typically accomplished by the Hall-Heroult Process. In this well known process, a purified source of the metal is dissolved in a molten salt bath particularly consisting of cryolite. All chloride salts, fluoride salts or heavy salts such as barium are then electrolytically recovered at a cathode. A characteristic advantage of this type of process is low cell power efficiency due to the low electrical conductivity of the electrolytic bath, since at least a portion of the electrical energy applied to the cell is converted by resistance to heat. The advantage of the Hall-Heroult Process (that is, cell power efficiency) has reached a practical limit in energy-saving efficiency despite careful design and operation of 150 to 200K. amp. cells at anode current densities ranging between 4.5 and 5.5 amp. per square inch. The lowest energy consumption limit appears to be about 5.6 to 6.0 kilowatt hours per pound of aluminum recovered utilizing the most advanced designs, computer controls, staff modifications, and other improvements.

One approach to solving this particular problem is illustrated by U.S. Pat. No. 4,338,177 issued to Withers et al. for an electrolytic cell for the production of aluminum. In this patent, there is disclosed an electrolytic cell comprising an anode of aluminum oxide and a reducing agent, a cathode, and a molten electrolyte which does not dissolve the aluminum oxide compound in substantial quantities when the temperature of the electrolyte is in the range of 650° to 900° C. The cell includes a porous membrane which separates the anode and the cathode, and comprises a material having a connected pore size sufficiently small to screen out the mixture of aluminum oxide and reducing agent, but sufficiently large to pass the aluminum ions therethrough. The energy consumption for such a cell ranges from about 3.67 to about 4.25 kwh/lb. of aluminum recovered.

SUMMARY OF THE INVENTION

It has been discovered that an electrolytic cell for the production of a metal with reduced electrical energy consumption includes the folowing elements:

(1) an electrolyte disposed in a cell;

(2) a cathode immersed in the electrolyte for electrolytic winning of the metal; and (3) an anode immersed in the electrolyte comprising an oxygen-containing compound of the metal;

the electrolyte comprising a material in which the metal oxide is substantially insoluble at normal electrolytic conditions, and the anode includes an effective amount of a selected N-type or P-type metal.

DETAILED DESCRIPTION OF THE INVENTION

The following process description will reference aluminum, but it is understood that the process is applicable to the recovery of any metal oxide, including but not limited to aluminum, magnesium, titanium, etc.

The electrolytic process of the present invention for the production of an aluminum metal at a cathode uses substantially less energy to produce high quality aluminum with the total absence of chlorine gas exiting from the cell. Production of the aluminum metal at the cathode is brought about through the formation of an anode from aluminum oxide and an effective amount of a selected N-type or P-type metal. The anode and the cathode are immersed in an electrolytic molten bath containing alkali metal or alkaline earth metal halide salt of selected compositions which is substantially insoluble to the metal oxide.

In the present invention, the bath composition may include any halide salt, but chloride and fluoride are particularly favored. Any alkali metal or alkaline earth metal such as sodium, potassium, lithium, calcium, magnesium, and barium may be used to form the halide salt.

The desired composition of the electrolytic bath provides that the metal oxide is substantially insoluble in the bath at normal electrolytic conditions. For purposes of definition herein, the term "substantially insoluble" is defined to be a concentration of the metal oxide of less than 0.5 weight percent of the electrolytic bath.

The anode provides the source of metal ions for the reduction to the metal at the cathode, as well as a means to conduct electrical current through the metal oxide to the reaction site for the metal oxide. In one embodiment, the anode may also provide at least a part of a necessary source of a reducing agent. The reducing agent is preferably at least in part intermixed with the metal oxide, but also may be in gaseous form in this embodiment to provide intimate contact with the metal oxide. The reducing agent should be selected to be conductive when intermixed with the metal oxide.

Metals suitable for use in this invention include N-type and P-type materials. Preferably, the N-type metal is selected from a group consisting of Group I and Group II metals of the Periodic Table. More preferably, the N-type metal is a Group I metal, particularly when magnesia is to be recovered. Preferably, when aluminum is the metal oxide to be processed, the second metal to be incorporated in the anode comprises sodium.

Preferably, the P-type metal is selected from a group consisting of Groups III, IV, and V metals. More preferably, when aluminum is to be recovered, the second metal comprises a metal selected from Group IV or Group V.

Preferably, the N-type or P-type metal comprises from about 1 part to about 100 parts per million of the anode.

The metal produced at the cathode generally is as pure as the metal material forming the anode. Bath temperatures generally range from about 700° to about 800° C., and preferably about 700° to about 750° C.

While the present invention has been described in terms of preferred embodiments, it is to be understood that the present invention is not limited thereto and that it can be variously practiced within the scope of the following claims.

Having thus described the invention and certain embodiments thereof, the invention which is claimed is:

1. An electrolytic cell for the production of a first metal comprising in combination:

(a) an electrolyte disposed in said cell;

(b) a cathode immersed in said electrolyte for electrolytic winning of said first metal; and (c) an anode comprising a mixture of an oxygencontaining compound of said first metal, and a second metal in an amount from about 1 part to about 100 parts per million of said anode;

said electrolyte comprising a material in which the oxide of said first metal is substantially insoluble at electrolytic conditions, and said second metal is selected from a group consisting of N-type and P-type metals.

2. The electrolytic cell of claim 1 wherein said N-type metal is selected from a group consisting of Group I and Group II metals.

3. The electrolytic cell of claim 1 wherein said first metal comprises magnesium and said second metal is selected from a group consisting of Group I metals.

4. The electrolytic cell of claim 1 wherein said first metal comprises aluminum and said second metal comprises sodium.

5. The electrolytic cell of claim 1 wherein said P-type metal is selected from a group consisting of Groups III, IV, and V metals.

6. The electrolytic cell of claim 5 wherein said oxygen-containing compound of said first metal comprises aluminum oxide and said second metal is selected from a group consisting of Group IV and Group V metals.

7. The electrolytic cell of claim 5 wherein said first metal comprises magnesium.

8. The electrolytic cell of claim 1 wherein said anode comprises a reducing agent.

* * * * *